US005425189A

United States Patent [19]

Anderson et al.

[11] Patent Number: 5,425,189

[45] Date of Patent: Jun. 20, 1995

[54] METHOD AND APPARATUS FOR RAKING WITH HEAVY EQUIPMENT

[76] Inventors: Kenneth C. Anderson, 6395 Clover Valley Rd. S.E., James E. Janaszak, 10407 SE. Olympiad Dr., both of Port Orchard, Wash. 98366

[21] Appl. No.: 181,660

[22] Filed: Jan. 14, 1994

[51] Int. Cl.[6] ..... E02F 3/70

[52] U.S. Cl. ..... 37/405; 37/403; 414/722

[58] Field of Search ..... 414/724, 722; 172/815, 172/112, 114; 37/405, 406, 407, 408, 409, 411

[56] References Cited

U.S. PATENT DOCUMENTS

| | | | |
|---|---|---|---|
| 3,706,388 | 12/1972 | Westendorf | 37/405 X |
| 3,765,553 | 10/1973 | Schaeff | 37/403 X |
| 3,834,567 | 9/1974 | Miller | 37/405 X |
| 3,967,397 | 7/1976 | Nault | 37/117.5 |
| 3,972,147 | 8/1976 | Bigham | 49/41 |
| 3,975,844 | 8/1976 | Olson | 37/117.5 |
| 4,056,205 | 11/1977 | Etzler | 214/145 |
| 4,125,952 | 11/1978 | Jennings | 37/405 |
| 4,222,186 | 9/1980 | Molby | 37/86 |
| 4,490,066 | 12/1984 | Hanlon | 403/387 |

FOREIGN PATENT DOCUMENTS

| | | |
|---|---|---|
| 231895 | 2/1964 | Austria . |
| 626034 | 12/1976 | U.S.S.R. . |

*Primary Examiner*—Dennis L. Taylor
*Assistant Examiner*—Robert Pezzuto
*Attorney, Agent, or Firm*—Don R. Mullick

[57] ABSTRACT

The application describes a method and apparatus for raking with heavy equipment. The apparatus includes a plurality of raking teeth attached to the top portion of a heavy equipment bucket. The apparatus is adaptable to such diverse heavy equipment as front loaders and backhoes. The method includes the use of top mounted teeth to rake pile and load raked material.

13 Claims, 3 Drawing Sheets

METHOD AND APPARATUS FOR RAKING WITH HEAVY EQUIPMENT

FIELD OF INVENTION

This invention pertains to Heavy Equipment, particularly, this invention pertains to attachments and methods for adapting existing heavy equipment for raking tasks.

BACKGROUND OF THE INVENTION

There are many types of heavy equipment in current use. For the purposes of this application heavy equipment is de, fined as power equipment for moving earth which includes a body containing a power source such as a diesel, gasoline or electric motor, a means of movement such as wheels or tracks connected to the power source, and a tool such as a movable blade or bucket attached to the body. Common names of such heavy equipment include bulldozer, loader, back hoe, and grader.

The different names relate to the blades and uses of the various types of heavy equipment. A bulldozer for example commonly includes a relatively fiat blade and tracks. In operation the blade is used to push material forward or to one side by tilting the blade. The blade can also be raised or lowered as well as rotated. Bulldozer blades commonly include a plurality of teeth on the lower edge of the blade to aid in digging. A bulldozer blade can also be used on a wheeled vehicle.

In a front end loader the blade is concave and is often called a bucket. In operation a front loader lowers the bucket to a digging position and advances forward. Material is then entrapped in the bucket which is next raised. The bucket may be rotated upward in this operation to prevent spillage. The bucket is finally rotated downward into the dump position to release the entrapped material.

A back hoe also includes a bucket. In a back hoe the bucket is usually mounted at the rear of the vehicle. The motions of the bucket are different than in a front loader and forward motion is not used to entrap material in the bucket. In a back hoe the bucket is rotated into the material sought to be removed from the dump position to a loaded position. The bucket is then raised upward with the material contained inside. The loaded bucket is commonly moved to one side and inverted to dump the contained material.

A grader blade is similar to a bulldozer blade but is usually used only at an angle to even or grade surfaces. Graders do not generally dump the material sought to be graded but rather move it to one side.

Each of the above types of heavy equipment may also be used for raking. Raking is a operation concerned with the removal of oversized material from a media. A common example would be the removal of construction debris from soil after a construction project. To use any of the above equipment for raking the blade or bucket is dismounted and replaced by a rake or a rake may be attached below the blade edge. The rake includes a plurality of teeth situated to dig into the soil. Material that is larger than the distance between the teeth is entrained when the rake is moved through the media. The material is next piled up by the rake for removal by another tool or burned in place.

A major disadvantage of raking in this manner is that the operation of attaching a rake is time consuming and somewhat difficult because both rakes and blades are heavy. When the rake is attached the equipment cannot be used for digging or loading. Since heavy equipment has a substantial hourly cost including that of the operator there has been a temptation to use the standard blades for raking tasks. The result has been generally unsatisfactory. For example if rake teeth are placed on the bottom edge of the bucket of a front loader or blade of a bulldozer the material sought to be raked tends to slide down off the edge of the bucket as one tries to pile the material up. In the case of a front loader the addition of raker teeth also impedes digging ability. Accordingly, there is a long-standing need to efficiently rake with equipment which can also be use for digging.

SUMMARY OF THE INVENTION

The invention provides an effective inexpensive method and apparatus for raking with heavy equipment. The invention is equally adaptable to any front end loader and back hoes. The invention allows normally digging, grading, and loading functions to be conducted before and after raking without impedance. The invention alleviates any need to change buckets or blades for different operations and can easily be added to existing equipment.

The apparatus of the invention includes a plurality of raking teeth. A mounting arrangement is provided to mount the raking teeth to the top of a heavy equipment bucket. The mounting can be varied to allow mounting the teeth to a loader or back hoe bucket. The mounting arrangement is simple yet strong to allow effective raking. Mounting the teeth to the top of the bucket allows normal operation of the equipment when not raking.

The method of the invention includes rotation of the bucket into full dump position. The teeth are now in contact with the media from which material is sought to be removed. The teeth are then moved through the media by moving the vehicle. The material is first caught then pushed by the teeth to a position where it may be piled. If desired the blade can then be rotated into the load position to load and remove the piled material without interference by the teeth.

DETAILED DESCRIPTION OF THE FIGURES

Figure 1:
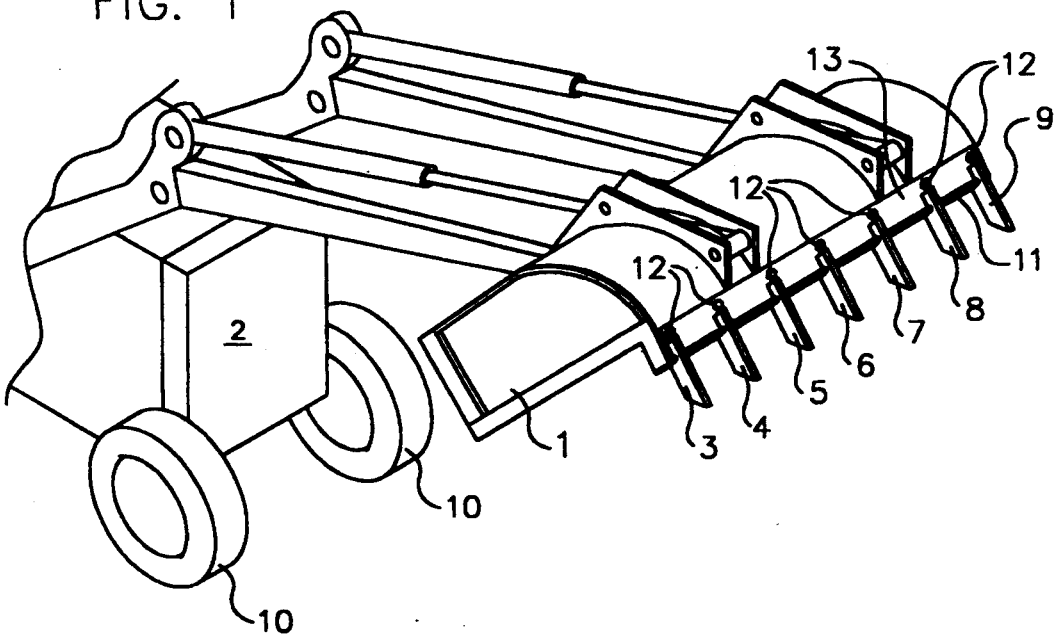
FIG. 1 is a perspective view of a front end loader incorporating the invention.

FIG. 1 is a perspective view of a front end loader incorporating the invention. A front loader 2 is shown with a bucket 1 attached to the front. As usual front loader 2 can be moved in forward and back directions by its wheels 10. Bucket 1 is seven feet wide and may be moved up and down as well as tilted by hydraulics included in front loader 2. Front loader 2 is a conventional 580 CASE front loader except for the additions listed below.

Attached to the top edge of bucket 1 are seven raker teeth 3–9. Attachment of teeth 3–9 to bucket 1 is by means of a top mounting plate 13 attached to bucket 1 by bolts 12. In this embodiment top mounting plate 13 is a seven foot long section of ½ inch thick 6 inch T-1 steel.

Teeth 3–9 are welded directly to plate 13. Teeth 3–9 are made from 12 inch long pieces of five inch by $1\frac{1}{4}$ inch mild steel. The ends of teeth 3–9 not attached to plate 13 are tapered. The top edge of bucket is covered by a front mounting plate 113. In this embodiment front mounting plate 11 is a seven foot long section of $\frac{1}{4}$ inch thick 5 inch T-1 steel. Teeth 3–9 are also welded directly to plate 11 which is in turn welded to plate 13. Plates 11 and 13 and associated teeth 3–10 are attached to bucket 1 by a plurality of bolts 12. In this embodiment there are 7 one inch grade 8 bolts 12. Holes must be drilled in bucket 1 to accept bolts 12. In operation the bucket is rotated into the full dump or FIG. 1 position. Moving front loader 2 in either direction forces teeth 3–9 into the media sought to be raked. Moving front loader forward removes material entrapped in the medium and entraps such material on the front of teeth 3–9. The trapped material can then be easily piled for removal.

Figure 2:
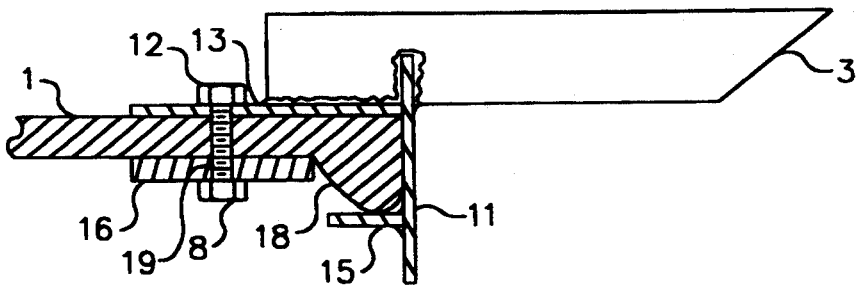
FIG. 2 is a section side elevation view of the FIG. 1 embodiment.

FIG. 2 is a section side elevation view of the FIG. 1 embodiment parts given a figure number in FIG. 1 retain that designation in FIG. 2. This view clearly shows the mounting of teeth 3 to bucket 1. As is common in front loader buckets bucket 1 is provided with a lip 18. A bottom mounting plate 16 is mounted directly adjacent to lip 18 on bucket 1. Plate 16 is a seven foot long piece of four inch by $\frac{1}{4}$ inch mild steel. Plate 16 is pierced by seven one inch holes 19 to accept bolts 12. Behind each hole a one inch grade 8 nut is welded to accept and attach bolts 12. In this manner teeth 3–9 are tightly but removably attached to bucket 1 allowing easy removal. A stop plate 15 may be added to prevent stressing bolts 12 when the invention is used in the reverse direction. Plate 15 is a seven foot long piece of $\frac{1}{4}$ inch T-1 steel welded to plate 11.

Figure 3:
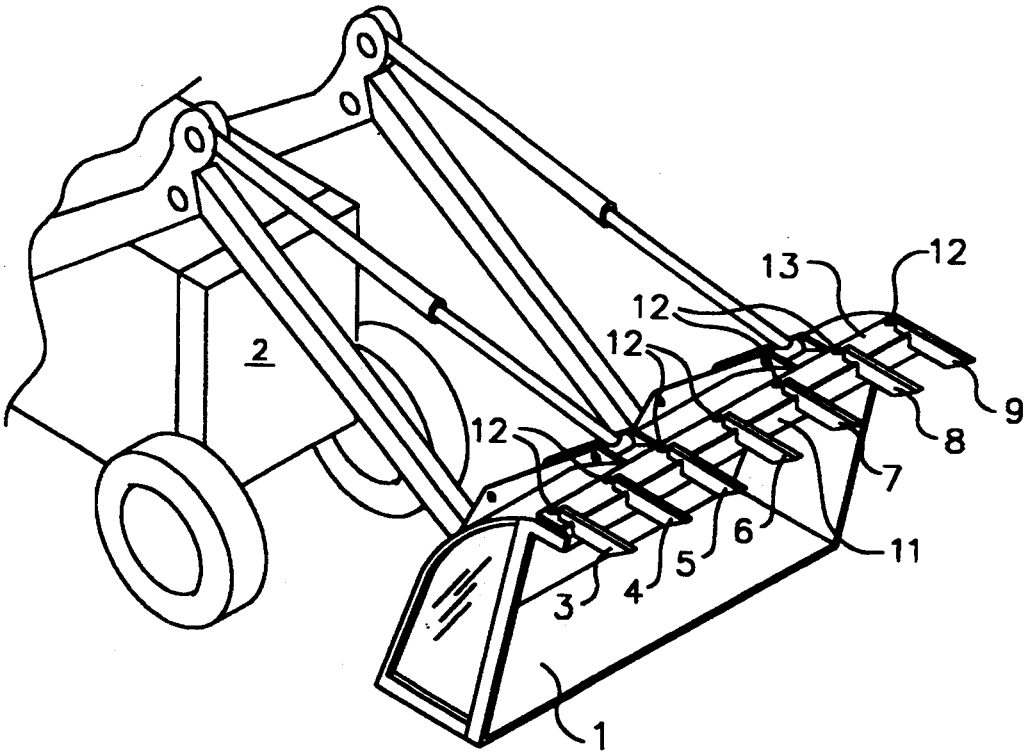
FIG. 3 is a of the FIG. 1 embodiment in loading position.

FIG. 3 is a perspective view of the FIG. 1 embodiment in loading position, parts given a figure number in FIG. 1 retain that designation in FIG. 3. In the FIG. 3 position teeth 3–9 are rotated up and away from the medium and material. Teeth 3–9 cannot interfere with loading operations while in the FIG. 3 position and front loader 2 can be used in the conventional manner. It should be noted that changing from the FIG. 1 to the FIG. 3 position requires no removal of parts or interference with either raking or loading operations. In a conventional front loader this change can be accomplished by movement of a single control on front loader 2 which controls bucket angle.

Figure 4:
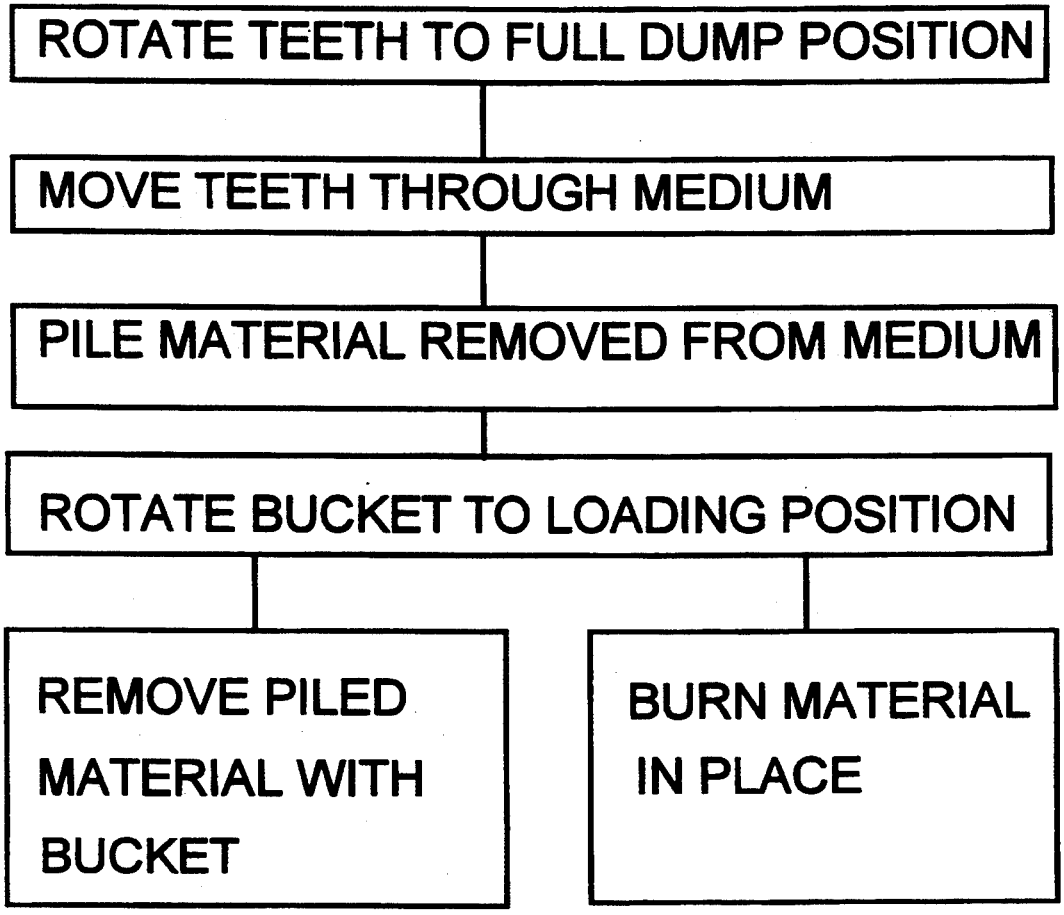
FIG. 4 is a flow chart of the method of the invention.

FIG. 4 is a flow chart of the method of the invention. Performance of this method requires the use of a piece of heavy equipment with a plurality of raking teeth mounted to the top edge of a bucket as illustrated in FIGS. 1–3. The first step is rotation of the teeth into a full dump position with the raker teeth substantially normal to the surface of the medium sought to be raked as in FIG. 1. Next the raker teeth are moved through the medium by moving the piece of heavy equipment forward and backward. The next step is piling the material removed from the medium with the raker teeth. Next, the bucket is rotated into the loading position as shown in FIG. 3. Next, the piled material is loaded into the bucket by pushing the bucket into the raked material. The process may be stopped here or the bucket may be placed over a suitable receptacle such as a container or bed of a truck and the bucket moved into the full dump position shown in FIG. 1, releasing any material contained therein. Alternatively, the material may be burned in place.

The above descriptions of embodiments are exemplary only the invention being defined solely by the attached claims.

We claim:

1. An apparatus for raking particles of material contained in a medium with a front end loader having a rotatable bucket that is movable in at least one direction normal to the front end of said bucket comprising: a plurality of raker teeth extending forward and normal to the top surface of said bucket wherein said teeth are mounted in such a manner as to be normal to the top edge of the bucket and have a ratio of width to length of at least 5 to 12; and, a first mounting plate attached to each of said raker teeth; and, a second mounting plate attached to said bucket opposite said first plate further including a plurality of means for receiving bolts; and, a third plate attached to said first plate at substantially a right angle parallel to the length of said bucket to conform to the front angle of said bucket and further attached to each of said raker teeth; and, a plurality of bolts for attaching said first plate to said bucket and said second plate.

2. A method for removing pieces of material contained in a medium with heavy equipment having a plurality of raker teeth mounted to the top side of a rotatable liftable bucket, comprising the steps of; rotating the bucket into a full dump position with the raker teeth substantially normal to the surface of the medium sought to be raked; and, moving the teeth through the medium by moving the piece of heavy equipment; and, piling the material removed from the medium with the raker teeth; and, rotating the bucket into a loading position; and, loading the raked material into the bucket by pushing the bucket into the raked material.

3. The method of claim 2, adapted for removing the raked material to a receptacle further comprising the steps of; placing the bucket over said receptacle, rotating the bucket moved into the full dump position shown, and, releasing any material contained in said bucket into said receptacle.

4. The method of claim 3, wherein said receptacle is a bed of a truck.

5. An apparatus as in claim 1 for removing particles of material contained in a medium with heavy equipment having a rotatable bucket and a means for moving the bucket comprising; a plurality of raker teeth, and means for attaching said raking teeth to the top edge of said bucket.

6. An apparatus as in claim 5, wherein said heavy equipment is a front end loader.

7. An apparatus as in claim 5, wherein said heavy equipment is a backhoe.

8. An apparatus as in claim 5, wherein said means for attaching teeth is dismountable from said bucket.

9. An apparatus as in claim 5, wherein said means for attaching said teeth to said bucket includes, a first mounting plate attached to each of said teeth and the top edge of said bucket.

10. An apparatus as in claim 9, wherein said mounting means includes a second mounting plate attached to the opposite side of said top edge of said bucket from said first mounting plate.

11. An apparatus as in claim 10, wherein said first mounting plate is attached to said second mounting plate and said bucket by a plurality of bolts passing through said bucket.

12. An apparatus as in claim 11, further comprising a third mounting plate attached normal to said first mounting plate and said raker teeth for covering the front edge of said top edge of said bucket.

13. An apparatus as in claim 12, wherein a plurality of nuts are attached to said second mounting plate for receiving said bolts.

* * * * *